US005467559A

United States Patent [19]

Owens

[11] Patent Number: 5,467,559

[45] Date of Patent: Nov. 21, 1995

[54] ELECTRICALLY OPERATED DROP SEAL FOR PASS DOORS IN OPERABLE WALLS

[75] Inventor: N. Douglas Owens, Lynn, Ind.

[73] Assignee: Modernfold, Incorporated, New Castle, Ind.

[21] Appl. No.: 276,947

[22] Filed: Jul. 19, 1994

[51] Int. Cl.[6] ..... E06B 7/28

[52] U.S. Cl. ..... 49/321; 49/170; 49/308; 49/316; 160/40

[58] Field of Search ..... 49/316, 321, 308, 49/307, 306, 170, 169; 160/40

[56] References Cited

U.S. PATENT DOCUMENTS

| | | | |
|---|---|---|---|
| 2,987,121 | 6/1961 | Haws | 160/40 |
| 3,086,261 | 4/1963 | Lapof | 160/40 |
| 3,098,519 | 7/1963 | Myers et al. | 160/199 |
| 3,126,050 | 3/1964 | Lapof | 160/40 |
| 3,802,480 | 4/1974 | Daggy | 160/40 |
| 4,277,920 | 7/1981 | Dixon | 49/321 X |
| 4,805,345 | 2/1989 | Ohi | 49/308 |
| 4,880,046 | 11/1989 | Gesy | 160/40 |
| 5,339,881 | 8/1994 | Owens | 160/40 |

OTHER PUBLICATIONS

Production Drawing 90001353, Modernfold, Inc. 1992.
Production Drawing 90001355, Modernfold, Inc. 1992.
Acousti–Seal 900 Series Technical Data Brochure, Modernfold, Inc. Form No. 2153R4, 1991.

*Primary Examiner*—Philip C. Kannan
*Attorney, Agent, or Firm*—Baker & Daniels

[57] ABSTRACT

An electrically operated drop seal assembly for a pass door in an operable wall. The drop seal assembly includes an actuator which is selectively movable by a motor between a first position and a second position. The assembly also includes a retractable drop seal which is movable between a retracted position spaced from the floor over which the pass door is suspended and a sealed position in sealing engagement with the floor. A coupling of the drop seal assembly converts movement of the actuator from the first position to the second position into movement of the retractable drop seal from the retracted position to the sealed position. The assembly also includes a pass door opening activated retractor for raising the retractable drop seal from the sealed position when the pass door is moved relative to the operable wall from a closed position to an opened position.

20 Claims, 5 Drawing Sheets

ELECTRICALLY OPERATED DROP SEAL FOR PASS DOORS IN OPERABLE WALLS

BACKGROUND OF THE INVENTION

This invention pertains to pass doors in operable walls movable to partition large rooms into smaller rooms, and, in particular, to a pass door drop seal which forms a sound barrier between the closed pass door and the floor above which the pass door is suspended.

Operable walls or partitions, also known as movable wall panel systems, find useful application in a variety of venues, such as classrooms, offices, convention centers and hospitals. In these venues, the operable walls can be utilized to efficiently compartmentalize interior space into a multitude of separate, smaller rooms. As it is frequently desirable for persons to be able to pass back and forth between the smaller rooms without opening, i.e. stacking, the operable walls, pass doors are often provided in the operable walls. In particular, usually an operable partition panel is provided with a doorway in which is installed a pass door which may be swingably hinged and latched as are conventional room doors.

One shortcoming associated with pass doors pertains to their acoustical integrity. In order for the rooms which are accessed by a pass door to provide a useful working environment free from acoustic disturbances, the pass doors when closed should serve as effective sound barriers. One passageway for sound to undesirably pass by a closed pass door between adjoining rooms is the space between the pass door's bottom edge and the floor.

In an effort to block this sound passageway, a variety of vertical expansion seals or drop seals have previously been employed. One type of drop seal, which is also known as a float seal, includes a strip of resilient material stretching the length of and attached to the bottom edge of the pass door. The resilient strip hangs down to the floor and floats or drags along the floor when the pass door is opened. These float seals also drag along the floor when the operable wall system is stacked or extended. While capable of blocking some portion of sounds, drop seals of this type have generally failed to provide adequate sound barrier properties for many particular installations.

Another known type of pass door drop seal is an adjustable fixed sweep or seal. This type of seal includes a drop seal channel attached to vertically extending rods received within tubes attached to the pass door at either pass door side edge. Rod engaging screws which extend through the tubes can be tightened to lock the rods within the tubes at a selected longitudinal location. The adjustable fixed seal installer can mechanically lower and set the seal at a fixed, operational height after the pass door operable partition is installed such that the seal contacts the floor. When the pass door is opened, the seal sweeps along the floor. Adjustable fixed seals have been utilized in continuously hinged, electrically driven operable partitions which employ automatic drop seals in intermediate partition panels. However, as each of these intermediate partition drop seals is typically actuated by the drop seal of the immediately forward or preceding partition, pass doors are normally limited to being near the most trailing panel, as pass doors are not equipped with these automated seals and therefore can not actuate the automatic drop seals of further trailing panels. Each panel trailing the pass door panel then may also be equipped with adjustable fixed seals.

Another known type of pass door drop seal is a crank down drop seal which is mechanically lowered to an operational alignment by an installer. Specifically, after the operable wall system has been extended and while the pass door is open, the drop seal is manually lowered or screwed down to an elevation spaced above the floor. This space allows the door to be swung open without the drop seal engaging the floor. In order to provide a sound barrier seal between the closed pass door and floor, the crank down drop seal includes a spring mechanism, cooperating with the doorjamb, which biases the drop seal downward into contact with the floor when the door is fully closed.

One shortcoming of this crank down drop seal is that cranking the drop seal down to an appropriate operational height requires trial and error and may therefore be burdensome on an installer. Another shortcoming of this crank down drop seal is that while useful for an operable partition separately movable relative to the other partitions, it is generally inappropriate for use with continuously hinged, driven operable partitions. In particular, to properly stack a standard operable partition which includes a pass door, the pass door needs to be closed, and as a result the seal of the crank down drop seal engages the floor. Unless an operator remembers to manually retract or crank up the drop seal in the closed pass door before moving the pass door partition with the other continuously hinged partitions, the drop seal will be dragged against the floor during partition movement. This dragging movement may damage the drop seal or the floor. Thus, it is desirable to provide a drop seal for pass doors which addresses these disadvantages.

SUMMARY OF THE INVENTION

In one form thereof, the present invention provides a pass door drop seal assembly for use with a pass door in an operable partition, wherein the pass door is suspended above a floor, and wherein the pass door is movable relative to the operable partition between an opened position and a closed position. The pass door drop seal assembly includes a motor and an actuator operatively connected to the motor. The actuator is selectively movable by the motor between a first position and a second position. The assembly also includes a retractable drop seal for providing a seal between the pass door and the floor, wherein the drop seal is movable between a retracted position above the floor and a sealed position in sealing engagement with the floor, and a coupling operatively connecting the actuator and the retractable drop seal arranged to convert movement of the actuator from the first position to the second position into movement of the retractable drop seal from the retracted position to the sealed position. The assembly also includes a pass door opening activated retractor for raising the retractable drop seal from the sealed position when the pass door is moved from the closed position to the opened position.

In another form thereof, the present invention provides a pass door drop seal assembly for use with a pass door in an operable partition including a doorjamb, wherein the pass door is suspended above a floor, and wherein the pass door moves relative to the operable partition between an opened position and a closed position. The pass door drop seal assembly includes a motor and actuator means operatively connected to the motor and selectively movable by the motor between a first position and a second position. The assembly includes a retractable drop seal for providing a seal between the pass door and the floor, wherein the drop seal is movable between a retracted position above the floor and a sealed position in sealing engagement with the floor. The assembly also includes linkage means between the actuator means and the retractable drop seal for converting movement of the actuator means from the first position to the second position into movement of the retractable drop seal from the retracted position to the sealed position. The assembly also includes means, cooperating with the operable partition doorjamb, for mechanically moving the actuator means from the second position toward the first position when the pass door is moved from the closed position to the opened position, whereby the retractable drop seal moves from the sealed position toward the retracted position.

In still another form thereof, the present invention provides a pass door drop seal-assembly for use with a pass door in an operable partition including a doorjamb, wherein the pass door is suspended above a floor, and wherein the pass door moves relative to the operable partition between an opened position and a closed position. The pass door drop seal assembly includes a motor and an actuator screw rod. The motor has a motor shaft, and the actuator screw rod is rotatably coupled to the motor shaft. The assembly includes at least one pivot block operatively connected to the actuator screw rod and movable along the axial length of the screw rod between a first position and a second position when the motor rotates the actuator screw rod. The assembly includes a drop seal for providing a seal between the pass door and the floor, wherein the drop seal is movable between a retracted position above the floor and a sealed position in sealing engagement with the floor, and a coupling, interconnecting the pivot block and the drop seal, structured to move the drop seal from the retracted position to the sealed position when the pivot block moves from the first position to the second position. The assembly also includes a pass door opening activated retractor, cooperating with the operable partition doorjamb, for moving the drop seal from the sealed position toward the retracted position when the pass door is moved from the closed position to the opened position.

An advantage of the pass door drop seal of the present invention is that it can be automatically lowered into a proper operational alignment. Another advantage of the electrically operated pass door drop seal of the present invention is that it can be electrically circuited with electric drop seals in the operable wall partition in which the pass door is installed so as to be automatically retractable when the partition drop seals are retracted. Still another advantage of the present invention is that a limit switch assembly cooperating with the floor can be utilized to ensure a proper seal with the floor.

BRIEF DESCRIPTION OF THE DRAWINGS

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 1:
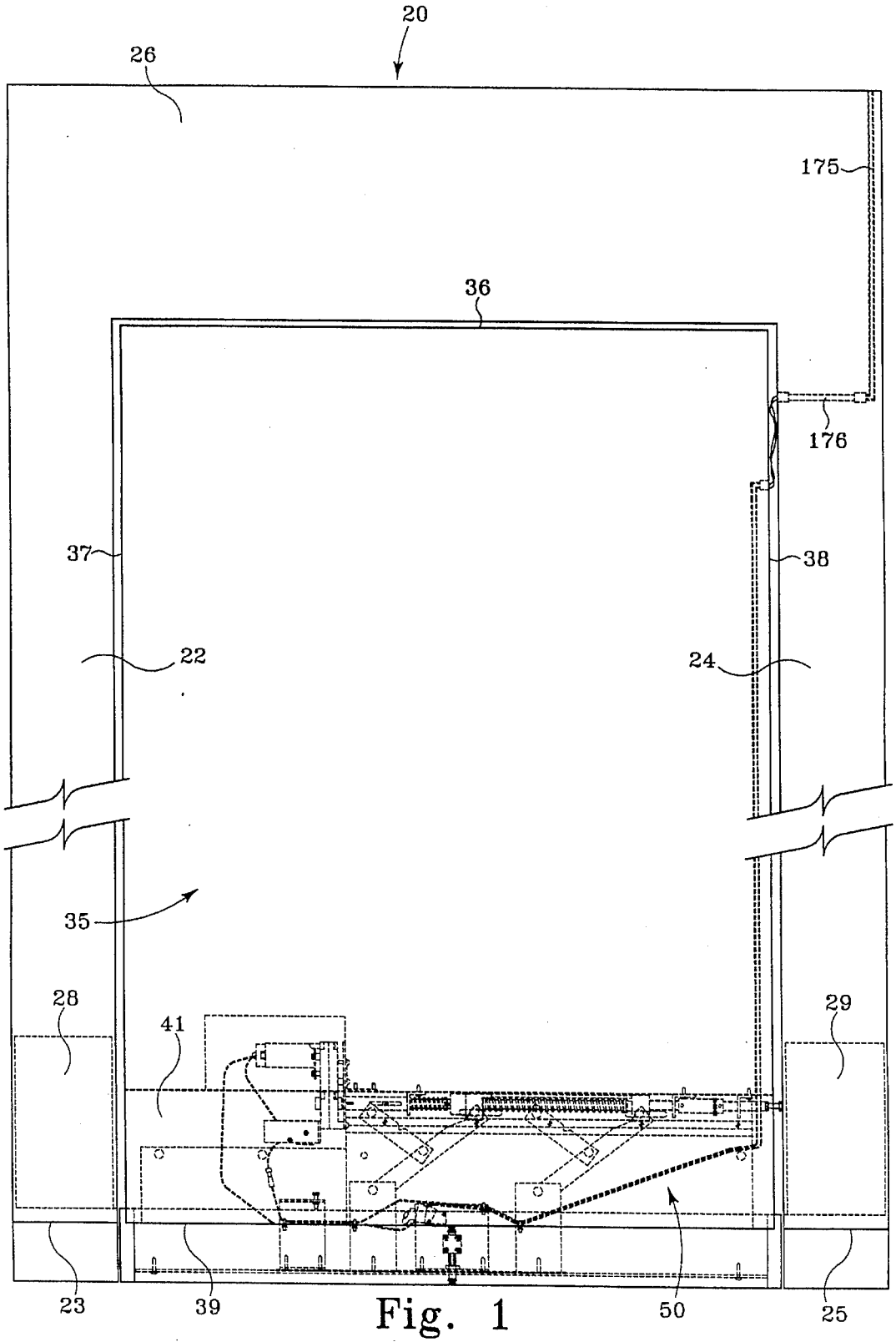
FIG. 1 is an abstract, front elevational view of an operable wall partition with a pass door equipped with a preferred embodiment of the electrically operated pass door drop seal assembly of the present invention.

Corresponding reference characters indicate corresponding parts throughout the several views. Although the drawings represent an embodiment of the invention, the drawings are not necessarily to scale and certain features may be exaggerated in order to better illustrate and explain the present invention. The exemplification set out herein illustrates a preferred embodiment of the invention, in one form, and such exemplification is not to be construed as limiting the scope of the invention in any manner.

DESCRIPTION OF THE PREFERRED EMBODIMENT

Referring to FIG. 1, there is abstractly shown a partial, front elevational view of an operable partition 20 used in a movable wall panel system. Operable partition 20 is oriented in an extended, wall forming alignment. The overhead track and trolley engagement, as well as the adjacent operable partitions of a conventional movable wall panel system, are not illustrated or described herein because the structural details thereof are known in the art and are not necessary for a clear understanding of the present invention. Operable partition 20 includes two wall leg sections 22, 24 which are spanned at their upper ends by wall transom section 26. A pass door, generally designated 35, fits within the doorway defined by wall leg sections 22, 24 and wall transom section 26. As abstractly shown in shadow in FIG. 1, separate electrically actuated drop seal assemblies 28, 29 are recessed within the bottom ends of wall leg sections 22, 24 and are electrically powered via wires which are circuited with the electrical supply and which extend down from the top of wall transom section 26 and through wall leg sections 22, 24. Drop seal assemblies 28, 29, which are shown extending a drop seal below the bottom edges 23, 25 of wall leg sections 22, 24, are further described in co-pending application Ser. No. 08/027,376, which is incorporated herein by reference.

Pass door 35, which may have a similar thickness and general construction as operable partition 20, is bounded by top edge 36, side edges 37, 38, and bottom edge 39. Pass door 35 is hinged to wall leg section 24 so as to be swingably opened relative to operable partition 20. Suitable seals closing in an air-tight fashion the joints between the partition doorway and the pass door top edge 36 and side edges 37, 38 are preferably provided to reduce sound transmission but are not shown. A door hand pull and latch are not shown but can be provided. At the bottom region of pass door 35 is formed an interior compartment 41 into which is mounted a preferred embodiment of the pass door drop seal assembly of the present invention, generally designated 50.

Figure 2:
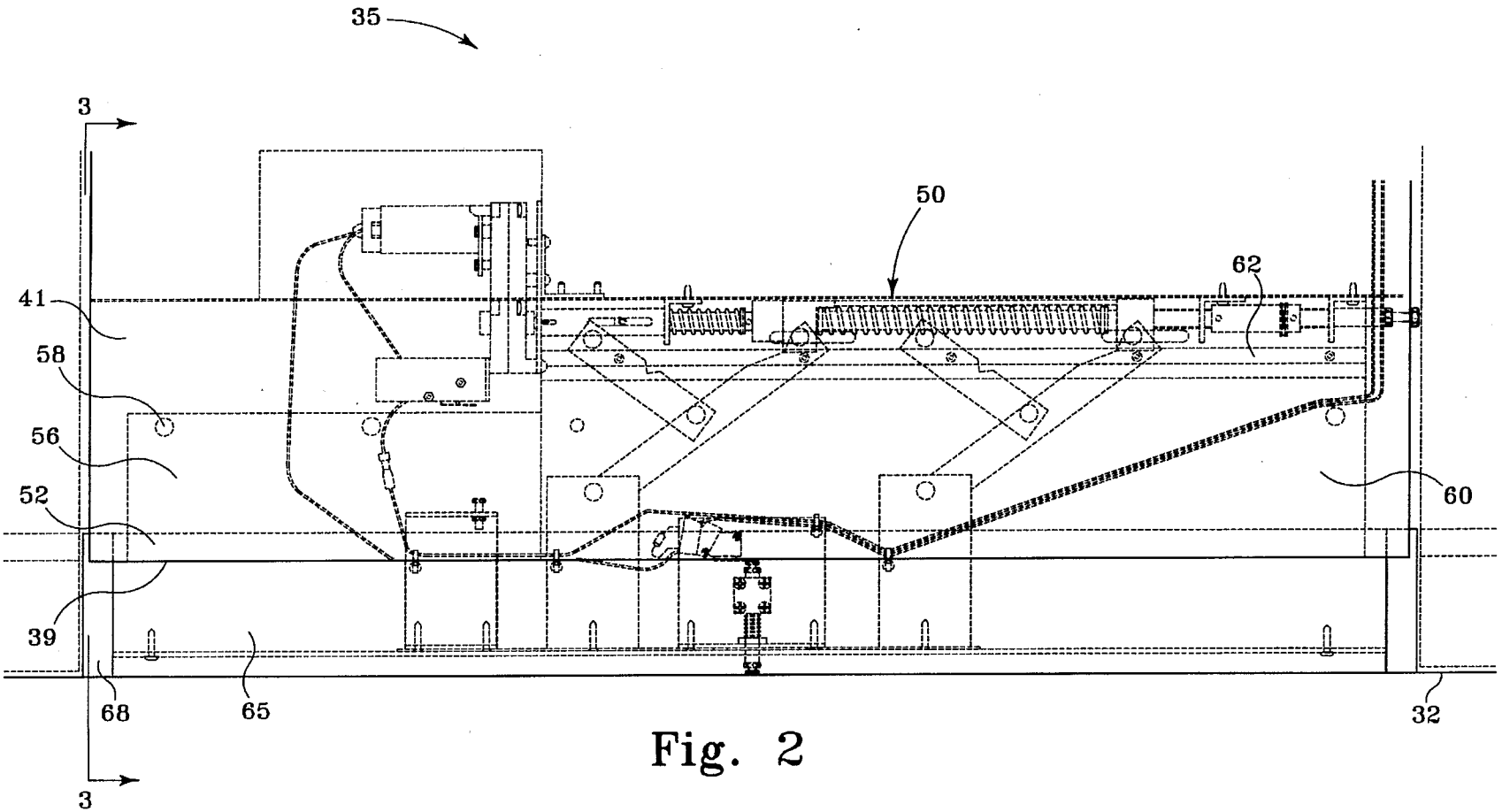
FIG. 2 is an enlarged view of the bottom region of the pass door and the pass door drop seal assembly of FIG. 1, with the bordering edges of the operable partition leg sections shown in shadow.
Figure 3:
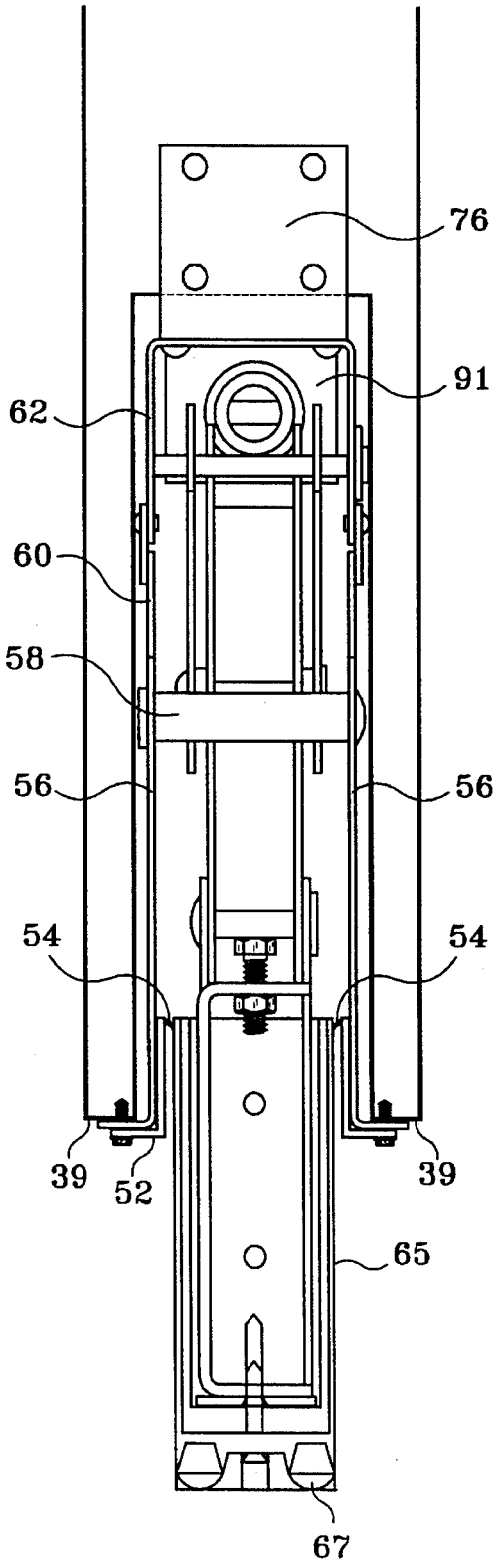
FIG. 3 is a left end elevational view taken along line 3—3 of FIG. 2 with the motor assembly, upper limit switch assembly, and the associated wiring removed for purposes of illustration.

Referring now to FIG. 2, shown in enlarged form is the lower portion of pass door 35 and its installed drop seal assembly 50, which is shown in a fully extended or lowered position engaging floor 32. This lower portion is further shown in a side view, taken along line of sight 3—3 in FIG. 2, wherein the gear motor assembly and its associated wiring, as well as the upper limit switch, are not shown. Attached to both the front and back sections of pass door bottom edge 39 via fasteners are vinyl sealing strips 52.

Inwardly extending lips 54 of strips 52 engage drop seal channel 65 to prevent sound from passing around channel 65 during use. Opposing rectangular plates 56, fixedly spaced by spacer tubes 58 and riveted together, are used to increase the rigidity of pass door 35 and include lower flanges which are fastened to pass door bottom edge 39 above strips 52. Opposing mounting plates 60 disposed adjacent rectangular plates 56 in FIG. 2 similarly include flanges at their lower ends which are fastened to pass door bottom edge 39 above strips 52. At their upper ends, both mounting plates 60 are fixedly attached, such as by rivets, to opposite ends of an inverted U-shaped channel support 62, which abuts the top surface of interior compartment 41. The dynamic components of drop seal assembly 50 are mounted to channel support 62 and are thereby secured to pass door 35.

Drop seal channel 65 is the portion of drop seal assembly 50 which is lowered during use as shown in FIG. 2 to form a sealing engagement with floor 32. Drop seal channel 65 is U-shaped and includes floor sealing strips 67 attached to its lower leg and sealing end caps 68 at either channel end substantially coterminous with the bottom extent of strips 67. Sealing strips 67 are aligned along the length of drop seal channel 65 and are pressed against the surface of floor 32 during use to provide an air-tight seal between pass door 35 and floor 32. At various times during operation as described below, drop seal channel 65 is raised or retracted into inner compartment 41 to provide clearance between sealing strips 67 and floor 32.

Figure 4:
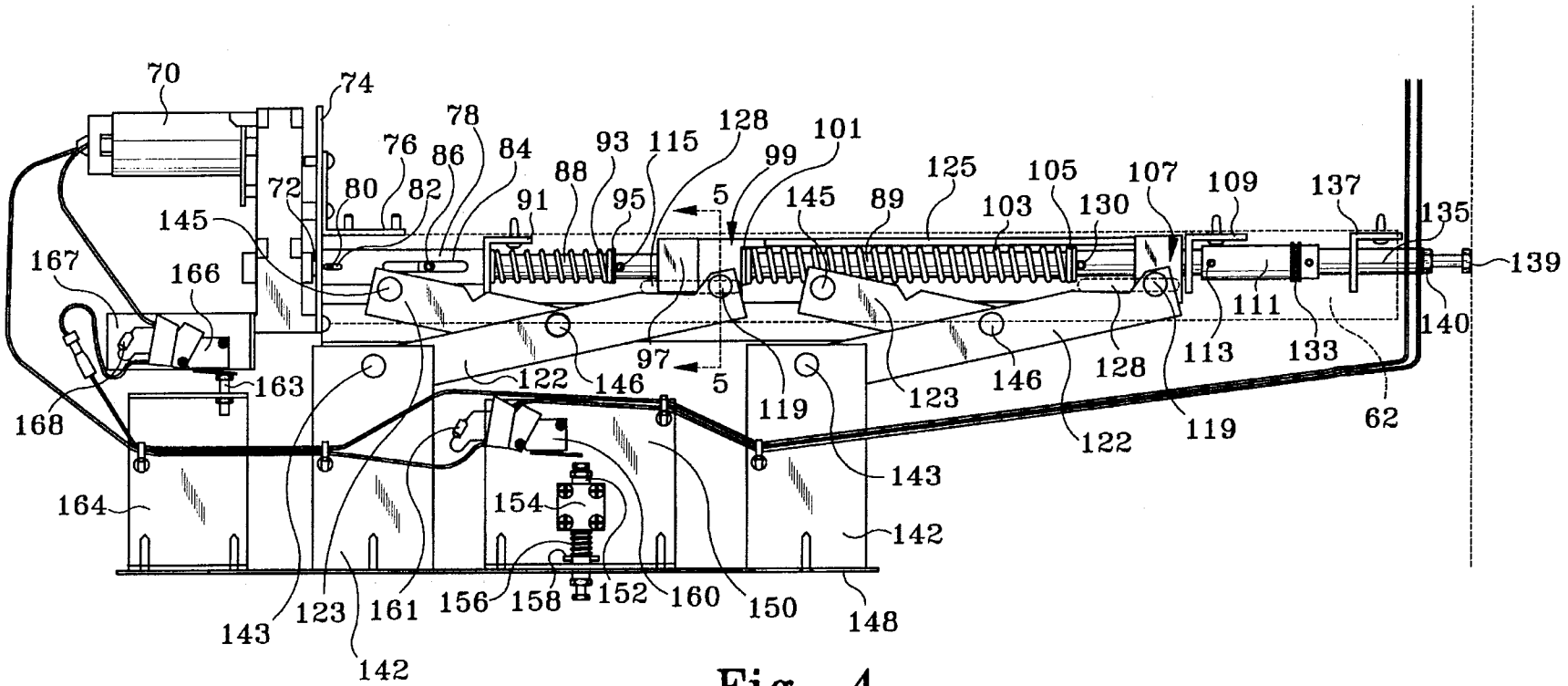
FIG. 4 is a front view of the pass door drop seal assembly of FIG. 2 removed from the pass door and with the installation components and floor engaging drop seal channel assembly removed for purposes of illustration.

Referring now to FIG. 4, the preferred mechanism of drop seal assembly 50 for raising and lowering drop seal channel 65 for and during use is illustrated removed from pass door 35, mounting plates 60, and drop seal channel 65. Channel support 62 is shown only in shadow. Motor 70, such as a 24 VDC reversible gear motor available from Howard Industries, Inc. of Milford, Ill., includes motor shaft 72 and is secured to motor mounting plate 74. Motor shaft is used broadly herein to refer to a shaft powered by the motor, and thereby encompasses the output shaft of the gear motor shown in this embodiment. Angled bracket 76 is fastened to both motor mounting plate 74 and channel support 62 to secure motor 70 relative to channel support 62. Motor shaft 72, which projects through an aperture in mounting plate 74, is connected to slip coupling 78 to transfer its rotation thereto by way of a radially extending spring or roll pin 80. Spring pin 80 is received within slots 82 disposed at 180° intervals around slip coupling 78.

A second pair of slots 84 at the distal end of slip coupling 78 receive opposite ends of spring pin 86. Pin 86 is radially inserted through the diameter at one end of actuator screw rod 88, which is threaded along a central region 89 of its axial length. From the left in FIG. 4, actuator screw rod 88 extends through angled screw support 91, compression spring 93, spring retaining washer 95, stop block 97, spring biased actuator pivot block assembly 99, washer 101, compression spring 103, washer 105, follower actuator pivot block assembly 107, and angled screw support 109. At its distal end, actuator screw rod 88 is connected to guide cylinder 111 by a radially inserted spring pin 113.

Angled screw supports 91, 109 are attached to channel support 62 with fasteners to support actuator screw rod 88. The opposite ends of compression spring 93 abut and during use are compressed between angled screw support 91 and spring retaining washer 95. Stop element 115, shown as a spring pin through actuator rod 88, abuts and limits axial movement of spring retaining washer 95. Stop block 97 includes a threaded bore which threadedly receives central threaded region 89 of actuator screw rod 88. The flat perimeter surfaces of stop block 97 closely fit within channel support 62 such that stop block 97 may slide along the length of channel support 62 but can not rotate therein. Consequently, as actuator screw rod 88 is rotated during operation, stop block 97 moves axially along screw rod 88 due to its threaded engagement therewith.

Figure 5:
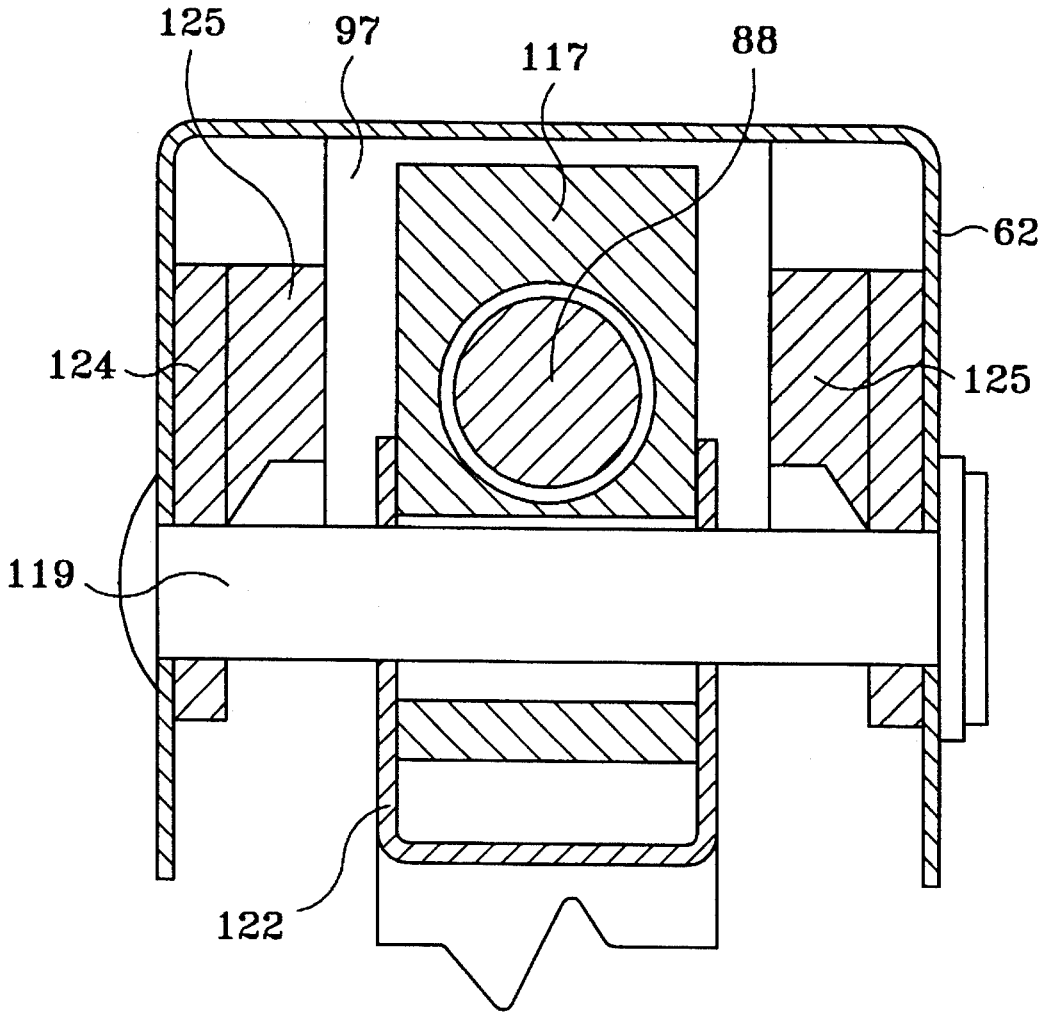
FIG. 5 is a cross-sectional view of the actuator pivot block assembly taken along line 5—5 in FIG. 4.

With reference to FIG. 5, the construction of spring biased actuator pivot block assembly 99 will be particularly explained. Follower actuator pivot block assembly 107 is substantively similar to spring biased actuator pivot block assembly 99, and therefore the following explanation has applicability to assembly 107. Actuator pivot block assembly 99 includes a parallelepiped shaped central block 117 with a smooth axial bore through which actuator rod 88 freely passes. Opposing side legs of U-shaped linkage arm 122 flank the sides of central block 117, and guide rivet 119 extends through a transverse bore in central block 117 and the legs of linkage arm 122. On either side of central block 117, guide rivet 119 extends through holes in downwardly extending ears 124 of connecting bar 125 and fits within guide slots 128 (see FIG. 4) formed in the vertically extending legs of U-shaped channel support 62. Connecting bar 125 operatively connects spring biased actuator pivot block assembly 99 with follower actuator pivot block assembly 107 such that forced motion of assembly 99 results in a corresponding motion of assembly 107. It will be appreciated that in an alternate design, the central blocks 117 of the actuator pivot block assemblies could threadably receive screw rod 88, thereby dispensing with stop block 97 and spring 103. However, the shown embodiment is preferred as the ability of central blocks 117 to slide along screw rod 88 against the force of spring 103 permits drop seal channel 65 to be pressed into compartment 41 when, for example, a heavy snow load on a building roof results in the slight downward deflection of a partition suspending track and thereby in pass door 35. Consequently, the drop seal assembly is not crushed against the floor but retracts slightly and thereby can avoid damage during such occurrences. Moreover, in a further alternate design, instead of being disposed on a rotating actuator rod, the actuator pivot block assemblies could be attached to a rod or bar having a rack which engages a motor pinion, wherein the rod longitudinally moves or translates during operation.

Referring again to FIG. 4, the ends of compression spring 103 engage washer 101 and washer 105, which respectively abut central block 117 (See FIG. 5) and spring pin 130 which is inserted through the diameter of actuator screw rod 88. Compression spring 103 maintains actuator pivot block assembly 99 in an operative engagement with stop block 97 such that motion of stop block 97 achieves a corresponding and simultaneous movement of actuator pivot block assembly 99.

Guide cylinder 111 extends axially from the end of actuator screw rod 88 and is connected via thrust bearing 133 to an activator rod assembly, generally designated 135. Activator rod assembly 135, which extends through angled bracket 137 secured to channel support 62, includes screw 139 and locking nut 140 at its distal end. As best shown in FIG. 1, screw 139 extends beyond side edge 38 of pass door 35 and engages the doorjamb formed by the inner face of operable partition leg section 24. Tightening or loosening screw 139 adjusts the distance drop seal channel 65 mechanically retracts, i.e. rises, when the pass door 35 is swung open as more fully described below. Thrust bearing 133 allows actuator screw rod 88 to rotate relative to activator rod assembly 135, and more particularly to screw 139, which preferably does not rotate while engaging the doorjamb.

The preferred coupling, which converts the horizontal motion of actuator pivot block assemblies 99, 107 caused by actuator rod 88 rotation into vertical motion of drop seal channel 65, includes a pair of linkage arms 122 and two sets of pivoting linkage bars 123. It will be appreciated that a variety of other couplings, including possibly pulley-type arrangements, which convert motion of actuator rod 88 into motion of drop seal channel 65 may be substituted for the below described linkage members. The upper ends of linkage arms 122 are operatively attached via guide rivets 119 to actuator pivot block assemblies 99, 107 as described above, and the lower end of each linkage arm 122 is rotatably attached to vertically aligned legs of identical U-shaped attachment brackets 142 by rivets 143. Each pair of pivoting linkage bars 123 is pivotally connected to channel support 62 by rivets 145. At their other ends, each pair of pivoting linkage bars 123 is connected to the middle length of linkage arms 122 by rivets 146. It will be appreciated that as actuator pivot block assemblies 99, 107 axially move along actuator rod 88, the upper ends of linkage arms 122 slide horizontally or axially as guided by the engagement of guide rivets 119 with channel support guide slots 128. As linkage bars 123 are constrained to pivot about rivets 145, the lower ends of linkage arms 122 at attachment brackets 142 experience vertical motion. While U-shaped channels are preferably used for linkage arms 122 due to their rigidity, otherwise formed or shaped linkages, including a single bar or pair of bars could be substituted within the scope of the invention.

The horizontal bottom leg of both attachment brackets 142 are secured to a horizontal connecting bar 148 to which drop seal channel 65 is securely mounted. Lower limit switch mounting plate 150 is also fastened to connecting bar 148. Mounted to the face of mounting plate 150 is a floor engaging lower limit switch assembly, which encompasses any device which engages floor 32 to signal the time to stop the lowering of drop seal channel 65 when it achieves a proper seal with floor 32. The preferred limit switch assembly includes plunger 152 slidably received within block 154 secured to mounting plate 150. Plunger 152 is spring biased downward relative to block 154 by a small compression spring 156 abutting the lower surface of block 154 and spring pin 158 through plunger 152. The lower end of plunger 152, which extends through connecting bar 148 and drop seal channel 65, and the upper plunger end each comprises a screw which can be adjusted to increase or decrease the effective length of plunger 152. When the lower plunger end positively contacts floor 32 when drop seal channel 65 is lowered, plunger 152 is raised against the biasing of spring 156 until the plunger upper end actuates lower limit switch 160, thereby opening the electric circuit. The electric leads of lower limit switch 160 are connected to the motor wiring as well as to silicon rectifier 161. Also attached to connecting bar 148 is an upper limit switch actuator which includes a vertically aligned projection or trigger 163 connected to C-shaped plate 164. Projection 163 is aligned below an upper limit switch assembly. This assembly includes upper limit switch 166, which is mounted to support plate 167 secured to the housing of motor 70 and which opens the electric circuit when positively engaged by projection 163. The electric leads of upper limit switch 166 are connected to the motor wiring as well as to silicon rectifier 168.

As shown in FIG. 1, a pair of electrical wires 175 in electrical communication with the power source pass downward through wall transom section 26 and wall leg section 24, horizontally through wire sleeve 176 and the joint between the doorjamb edge of wall leg section 24 and pass door 35, and downward along pass door 35 to be electrically connected through lower limit switch 160 and upper limit switch 166 to motor 70. The electrical wires can be attached with ties to holes in brackets 142 and plates 150, 164 to keep the wires clear of moving parts.

The preferred structure of pass door drop seal assembly 50 will be further understood in view of the following explanation of its operation. When operable partition 20 is arranged in a storage, stacked position, and during its movement to an extended wall-forming position, pass door 35 is closed and drop seal assembly 50 is arranged in a fully retracted position as shown in FIG. 4. When drop seal assembly 50 is arranged in the fully retracted position, drop seal channel 65 is recessed within pass door 35 and sealing strips 67 are spaced from floor 32 so as not to be dragged off or damaged by floor 32 when pass door 35 is transported thereover. It will be appreciated that because pass door 35 is closed, screw 139 of activator rod assembly 135 has engaged the doorjamb, represented in FIG. 4 by the dashed line, which has mechanically forced actuator rod 88 to the left in FIG. 4 against the biasing force of compressed compression spring 93.

When operable partition 20 moves to its wall forming position, the drop seals therein as well as the drop seals in the other partitions forming the wall system are lowered to form a sound barrier seal between the partitions' lowered edge and floor 32. In particular, drop seal assemblies 28, 29 are electrically powered and automatically extend. Pass door drop seal assembly 50 is circuited to the same power source as drop seal assemblies 28, 29 and is therefore simultaneously energized to automatically lower.

Specifically, power is circuited to motor 70 such that motor shaft 72 and slip coupling 78 begin to rotate in a first direction. Due to its connection with slip coupling 78, actuator screw rod 88 rotates synchronously. Due to its threaded engagement with screw rod 88, stop block 97 moves to the left in FIG. 4. Compression spring 103, which had been compressed when drop seal channel 65 was previously raised, urges actuator pivot block assembly 99 against stop block 97 and therefore to the left. Connecting bar 125 results in actuator pivot block assembly 107 moving simultaneously with and a similar amount as actuator pivot block assembly 99. The coupling achieved by linkage arms 122 and linkage bars 123 converts the horizontal motion of pivot block assemblies 99, 107 into a lowering motion of drop seal channel 65. Drop seal channel 65 continues to lower until the lower end of plunger 152 contacts floor 32 and is forced upward against resistance provided by compression spring 156. When the upper end of plunger 152 triggers lower limit switch 160, the electric circuit is broken and power to motor 70 is ceased, thereby halting the lowering of drop seal channel 65. After the drop seals of the intermediate partitions and pass door 35 are lowered, the preferred common power source switches off such that no additional electric power reaches the device through electrical wires 175. It will be appreciated that the screws at the plunger ends allow adjustments as to the amount which the drop seal floor sealing strips 67 are compressed against floor 32. Moreover, the play due to the use of rivets in the linkage assembly provides drop seal channel 65 with enough play to be angled to account for slightly uneven surfaces. When electrically fully lowered, pass door drop seal assembly 50 is arranged as shown in FIG. 2 and ready for use.

When pass door 35 is opened relative to partition 20, drop seal channel 65 is mechanically raised. Specifically, as pass door 35 is swung open, screw 139 is swung away from engagement with the doorjamb formed by the inner face of operable partition leg section 24. Consequently, compression spring 93, which had been compressed between angled screw support 91 and spring retaining washer 95 when pass door 35 was previously closed, extends and through its engagement with stop element 115 forces actuator rod 88 to translate to the right in FIG. 4. The translation of actuator rod 88 is halted when spring pin 86 reaches the end of slots 84 in slip coupling 78. As stop block 97 is threadably attached to actuator rod 88 and translates therewith, operatively connected actuator pivot block assemblies 99, 107 also move to the right. Because channel support 62 is fixed to pass door 35 and therefore linkage bars 123 do not translate but merely pivot, movement of actuator pivot block assemblies 99, 107 cause linkage arms 122 to rotate slightly in a clockwise fashion in FIG. 4. As a result, drop seal channel 65 is raised about one quarter inch off floor 32 such that sealing strips 67 do not drag against floor 32 as pass door 35 proceeds to be swung open. It will be appreciated that even though plunger 152 is spring biased out of engagement with lower limit switch 160 during this channel raising, motor 70 is not energized to lower the drop seal channel as power is not available through wires 175 as described above. When pass door 35 is eventually closed, activator rod assembly 135 reengages the doorjamb to return actuator screw rod 88 to the left in FIG. 4 to lower drop seal channel 65 to an operational, floor engaging position. It will be appreciated that while the above mechanical assembly achieving drop seal retraction when the pass door is opened is preferred due to its simple construction, other pass door opening activated retractors of the drop seal channel are possible. For instance, activator rod assembly 135 could be circuited with motor 70 and a battery pack to achieve movement of the actuator pivot block assemblies.

In order to stack or move partition 20, its drop seals are raised. Drop seal assemblies 28, 29 and pass door seal assembly 50, as well as the drop seals in the other partitions, are preferably circuited to automatically raise their respective drop seals at the same time. To raise the drop seal channel 65, current from the switched on power source to motor 70 is reversed such that motor shaft 72 rotates in a direction opposite to the first direction. It will be appreciated that silicon rectifier 161 allows current for motor 70 to bypass the open electrical circuit in lower limit switch 160. The resulting rotation of actuator rod 88 and movement of stop block 97 forces actuator pivot block assemblies 99, 107 to the right to thereby rotate linkage arms 122 and cause drop seal channel 65 to be raised. Drop seal channel 65 continues to rise until the top of projection 163 triggers upper limit switch 166. The triggering breaks the electric circuit and power to motor 70 is ceased, thereby halting the raising of drop seal channel 65 in a fully retracted position. It will be appreciated that silicon rectifier 168 allows current for motor 70 to bypass the open electrical circuit in upper limit switch 166 when motor 70 is later used to lower drop seal channel 65. Pass door assembly 50 is then arranged for storage as shown in FIG. 4.

While this invention has been described as having a preferred design, the present invention may be further modified within the spirit and scope of this disclosure. For instance, rather than effecting actuator rod 88, the activator rod assembly could be connected with a mechanism which directly engages the coupling or the drop seal channel to raise the channel when the pass door is opened. In addition, rivets are merely one type of mechanical fastener or connector which can be utilized. This application is therefore intended to cover any variations, uses, or adaptations of the invention using its general principles. Further, this application is intended to cover such departures from the present disclosure as come within known or customary practice in the art to which this invention pertains.

What is claimed is:

1. A pass door drop seal assembly for use with a pass door in an operable partition, wherein the pass door is suspended above a floor, and wherein the pass door is movable relative to the operable partition between an opened position and a closed position, the pass door drop seal assembly comprising:

a motor;

an actuator operatively connected to said motor and selectively movable by said motor between a first position and a second position;

a retractable drop seal for providing a seal between the pass door and the floor, said drop seal being movable between a retracted position above the floor and a sealed position in sealing engagement with the floor;

a coupling operatively connecting said actuator and said retractable drop seal arranged to convert movement of said actuator from the first position to the second position into movement of said retractable drop seal from the retracted position to the sealed position; and a pass door opening activated retractor for raising said retractable drop seal from the sealed position when the pass door is moved from the closed position to the opened position.

2. The pass door drop seal assembly of claim 1 further comprising a floor engaging lower limit switch assembly circuited with said motor.

3. The pass door drop seal assembly of claim 2 wherein said floor engaging lower limit switch assembly comprises a floor engaging plunger and a limit switch triggerable by said plunger.

4. The pass door drop seal assembly of claim 1 further comprising an upper limit switch assembly circuited with said motor.

5. The pass door drop seal assembly of claim 4 wherein said upper limit switch assembly comprises a triggering member and an upper limit switch, wherein one of said triggering member and said upper limit switch are operatively connected to said retractable drop seal to be vertically movable therewith.

6. The pass door drop seal assembly of claim 1 wherein said actuator comprises a screw rod and first and second pivot block assemblies, wherein said first and second pivot block assemblies are movable between the first position and the second position upon rotation of said screw rod, and wherein said pivot block assemblies are connected to said coupling.

7. The pass door drop seal assembly of claim 6 wherein said pivot block assemblies are movable along an axial length of said screw rod and are connected together by a connecting member.

8. The pass door drop seal assembly of claim 6 wherein said actuator further comprises a stop block and a compression spring, wherein said stop block threadedly engages said screw rod, and wherein said compression spring biases said first pivot block assembly into engagement with said stop block, whereby rotation of said screw rod moves said stop block to thereby achieve movement of said first pivot block assembly.

9. The pass door drop seal assembly of claim 1 wherein said motor comprises a rotatable motor shaft, and wherein said actuator comprises a screw rod and a slip coupling connecting said screw rod to said motor shaft.

10. The pass door drop seal assembly of claim 1 wherein said actuator comprises a screw rod, wherein said pass door opening activated retractor comprises an activator rod assembly structured and arranged to engage a doorjamb when the pass door is in a closed position, and wherein said screw rod and said activator rod assembly are operatively interconnected by a thrust bearing.

11. A pass door drop seal assembly for use with a pass door in an operable partition including a doorjamb, wherein the pass door is suspended above a floor, and wherein the pass door moves relative to the operable partition between an opened position and a closed position, the pass door drop seal assembly comprising:

a motor;

actuator means operatively connected to said motor and selectively movable by said motor between a first position and a second position;

a retractable drop seal for providing a seal between the pass door and the floor, said drop seal being movable between a retracted position above the floor and a sealed position in sealing engagement with the floor;

linkage means between said actuator means and said retractable drop seal for converting movement of said actuator means from the first position to the second position into movement of said retractable drop seal from the retracted position to the sealed position; and means, cooperating with the operable partition doorjamb, for mechanically moving said actuator means from the second position toward the first position when the pass door is moved from the closed position to the opened position, whereby said retractable drop seal moves from the sealed position toward the retracted position.

12. The pass door drop seal assembly of claim 11 further comprising lower limit switch means, positively cooperating with the floor and circuited with said motor, for halting the lowering of said retractable drop seal when said retractable drop seal reaches said sealed position.

13. The pass door drop seal assembly of claim 12 wherein said lower limit switch means comprises a floor engaging plunger and a limit switch triggerable by said plunger.

14. The pass door drop seal assembly of claim 11 further comprising an upper limit switch means, circuited with said motor, for halting the raising of said retractable drop seal when said retractable drop seal reaches said retracted position.

15. The pass door drop seal assembly of claim 11 wherein said motor comprises a rotatable motor shaft, and wherein said actuator means comprises a screw rod and a slip coupling connecting said screw rod to said motor shaft.

16. The pass door drop seal assembly of claim 11 wherein said actuator means comprises a screw rod, wherein said means for mechanically moving said actuator means comprises an activator rod assembly structured and arranged to positively engage the doorjamb when the pass door is in a closed position, and wherein said screw rod and said activator rod assembly are operatively interconnected by a thrust bearing.

17. The pass door drop seal assembly of claim 11 wherein said actuator means comprises a screw rod and first and second pivot block assemblies, wherein said first and second pivot block assemblies are movable between the first position and the second position upon rotation of said screw rod, and wherein said pivot block assemblies are connected to said linkage means.

18. A pass door drop seal assembly for use with a pass door in an operable partition including a doorjamb, wherein the pass door is suspended above a floor, and wherein the pass door moves relative to the operable partition between an opened position and a closed position, the pass door drop seal assembly comprising:

a motor including a motor shaft;

an actuator screw rod rotatably coupled to said motor shaft, said actuator screw rod including an axial length;

at least one pivot block operatively connected to said actuator screw rod and movable along said axial length between a first position and a second position when said motor rotates said actuator screw rod;

a drop seal for providing a seal between the pass door and the floor, the drop seal movable between a retracted position above the floor and a sealed position in sealing engagement with the floor;

a coupling, interconnecting said at least one pivot block and said drop seal, structured to move said drop seal from said retracted position to said sealed position when said at least one pivot block moves from said first position to said second position; and a pass door opening activated retractor, cooperating with the operable partition doorjamb, for moving said drop seal from the sealed position toward the retracted position when the pass door is moved from the closed position to the opened position.

19. The pass door drop seal assembly of claim 18 further comprising a lower limit switch assembly including a lower limit switch, circuited with the motor, and a floor engaging plunger, said plunger being structured and arranged to trigger the lower limit switch when said drop seal is lowered to the sealed position.

20. The pass door drop seal assembly of claim 18 further comprising an upper limit switch assembly including an upper limit switch, circuited with said motor, and a trigger element, said trigger element being structured and arranged to trigger the upper limit switch when said drop seal is raised to the retracted position.

* * * * *